US011047195B2

(12) United States Patent
LaGrange et al.

(10) Patent No.: US 11,047,195 B2
(45) Date of Patent: Jun. 29, 2021

(54) PERFORATING GUN

(71) Applicant: OWEN OIL TOOLS LP, Houston, TX (US)

(72) Inventors: Timothy E. LaGrange, Rainbow, TX (US); Jeremy Ursi, Frisco, TX (US); Jeffrey D. Wood, Keller, TX (US); Morris Stone, Granbury, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 0 days.

(21) Appl. No.: 16/509,315

(22) Filed: Jul. 11, 2019

(65) Prior Publication Data

US 2019/0330950 A1 Oct. 31, 2019

Related U.S. Application Data

(62) Division of application No. 15/088,677, filed on Apr. 1, 2016, now Pat. No. 10,422,195.
(Continued)

(51) Int. Cl.
*E21B 29/02* (2006.01)
*E21B 43/11* (2006.01)
*E21B 43/119* (2006.01)

(52) U.S. Cl.
CPC ..... *E21B 29/02* (2013.01); *E21B 43/11* (2013.01); *E21B 43/119* (2013.01)

(58) Field of Classification Search
CPC ..... E21B 43/11; E21B 43/117; E21B 43/116; E21B 29/02; F42B 5/02; F42B 5/035; F42D 1/02; F42D 1/041
See application file for complete search history.

(56) References Cited

U.S. PATENT DOCUMENTS 2,649,046 A 8/1953 Davis
4,139,222 A 2/1979 Loland
(Continued)

FOREIGN PATENT DOCUMENTS

EP 0352947 A2 1/1990
EP 1473437 A2 11/2004
(Continued)

OTHER PUBLICATIONS

Annex to Form PCT/ISA/206 Communication relating to the results of the Partial International Search.
(Continued)

*Primary Examiner* — Jennifer H Gay
(74) *Attorney, Agent, or Firm* — Mossman, Kumar & Tyler PC

(57) ABSTRACT

In aspects, the present disclosure provides a perforating gun that includes a carrier tube, and a charge tube assembly. The carrier tube includes a bore and a groove formed along an inner surface. The charge tube assembly is disposed in the bore of the carrier tube and includes a charge tube, an alignment end plate, an insertion end plate, a retention member, shaped charges, and a detonating cord. The charge tube has a plurality of shaped charge openings, a plurality of post openings, a first end, and a second end. The alignment end plate is connected to the first end of the charge tube. The insertion end plate is connected to the second end of the charge tube. The shaped charges are disposed in each of the shaped charge openings. Each shaped charge has a post projecting out of one post opening. The detonating cord is connected to each of the projecting posts.

7 Claims, 5 Drawing Sheets

Related U.S. Application Data

(60) Provisional application No. 62/142,313, filed on Apr. 2, 2015.

(56) References Cited

U.S. PATENT DOCUMENTS

| | | | | |
|---|---|---|---|---|
| 4,583,602 | A | 4/1986 | Ayers | |
| 4,621,396 | A * | 11/1986 | Walker | E21B 43/117 102/321.1 |
| 4,753,301 | A | 6/1988 | Berry | |
| 4,773,299 | A * | 9/1988 | Oestreich | E21B 43/117 102/310 |
| 4,850,438 | A | 7/1989 | Regalbuto | |
| 4,889,183 | A | 12/1989 | Sommers et al. | |
| 5,007,486 | A | 4/1991 | Ricles | |
| 5,054,564 | A * | 10/1991 | Oestreich | E21B 43/117 102/320 |
| 5,241,891 | A | 9/1993 | Hayes et al. | |
| 5,273,121 | A | 12/1993 | Kitney et al. | |
| 5,598,891 | A | 2/1997 | Snider et al. | |
| 5,603,379 | A | 2/1997 | Henke et al. | |
| 5,797,464 | A | 8/1998 | Pratt et al. | |
| 5,816,343 | A | 10/1998 | Markel et al. | |
| 6,006,833 | A | 12/1999 | Burleson et al. | |
| 6,220,355 | B1 | 4/2001 | French | |
| 6,662,883 | B2 | 12/2003 | Bonkowski | |
| 6,851,471 | B2 | 2/2005 | Barlow et al. | |
| 7,520,203 | B2 | 4/2009 | An | |
| 7,762,351 | B2 | 7/2010 | Vidal | |
| 7,861,785 | B2 | 1/2011 | Frazier et al. | |
| 8,033,333 | B2 | 10/2011 | Frazier et al. | |
| 8,157,012 | B2 | 4/2012 | Frazier | |
| 8,443,886 | B2 | 5/2013 | Torres et al. | |
| 8,684,083 | B2 | 4/2014 | Torres et al. | |
| 8,943,944 | B2 | 2/2015 | Zhang et al. | |
| 8,960,289 | B2 | 2/2015 | Zhang et al. | |
| 9,027,667 | B2 | 5/2015 | Zhang et al. | |
| 9,115,572 | B1 * | 8/2015 | Hardesty | E21B 43/119 |
| 9,145,763 | B1 | 9/2015 | Sites, Jr. | |
| 9,194,219 | B1 | 11/2015 | Hardesty et al. | |
| 9,297,242 | B2 | 3/2016 | Zhang et al. | |
| 9,297,243 | B2 | 3/2016 | Zhang et al. | |
| 9,382,783 | B2 | 7/2016 | Langford et al. | |
| 10,273,788 | B2 * | 4/2019 | Bradley | E21B 43/1185 |
| 10,422,195 | B2 * | 9/2019 | LaGrange | E21B 43/11 |
| 2003/0047358 | A1 | 3/2003 | Bonkowski | |
| 2004/0216866 | A1 | 11/2004 | Barlow et al. | |
| 2007/0084336 | A1 | 4/2007 | Neves | |
| 2007/0240561 | A1 | 10/2007 | An | |
| 2008/0073081 | A1 | 3/2008 | Frazier et al. | |
| 2009/0065194 | A1 | 3/2009 | Frazier | |
| 2010/0089643 | A1 | 4/2010 | Vidal | |
| 2010/0263523 | A1 | 10/2010 | Lagrange et al. | |
| 2011/0094745 | A1 | 4/2011 | Frazier et al. | |
| 2012/0250208 | A1 | 10/2012 | Love et al. | |
| 2013/0118342 | A1 | 5/2013 | Tassaroli | |
| 2013/0153205 | A1 | 6/2013 | Borgfeld et al. | |
| 2014/0000877 | A1 | 1/2014 | Robertson et al. | |
| 2014/0053715 | A1 | 2/2014 | Zhang et al. | |
| 2015/0337635 | A1 | 11/2015 | Langford et al. | |
| 2016/0097264 | A1 | 4/2016 | Upchurch et al. | |
| 2016/0281477 | A1 * | 9/2016 | Langford | E21B 43/117 |
| 2016/0290084 | A1 | 10/2016 | Lagrange et al. | |
| 2017/0115102 | A1 | 4/2017 | Knight et al. | |
| 2017/0211363 | A1 | 7/2017 | Bradley et al. | |
| 2017/0268317 | A1 | 9/2017 | Von et al. | |
| 2017/0275974 | A1 | 9/2017 | Von et al. | |
| 2017/0314373 | A9 * | 11/2017 | Bradley | F42B 3/08 |
| 2019/0085664 | A1 * | 3/2019 | Hardesty | E21B 43/116 |
| 2019/0330950 | A1 * | 10/2019 | LaGrange | E21B 43/119 |
| 2019/0330961 | A1 * | 10/2019 | Knight | E21B 43/117 |
| 2020/0157924 | A1 * | 5/2020 | Melhus | E21B 43/119 |

FOREIGN PATENT DOCUMENTS

| | | | |
|---|---|---|---|
| WO | 2010043941 | A1 | 4/2010 |
| WO | 2014179669 | A1 | 11/2014 |
| WO | 2015102620 | A1 | 7/2015 |
| WO | 2015156771 | A1 | 10/2015 |
| WO | 2015179787 | A1 | 11/2015 |
| WO | 2015195114 | A1 | 12/2015 |
| WO | 2016039734 | A1 | 3/2016 |
| WO | 2016039735 | A1 | 3/2016 |

OTHER PUBLICATIONS

"Snap Ring", https://www/merriam-webster.com/dictionary/snap%20ring, downloaded Oct. 17, 2018, 7 pages (Year: 2018).

* cited by examiner

PERFORATING GUN

CROSS-REFERENCE TO RELATED APPLICATIONS

This application is a divisional of U.S. application Ser. No. 15/088,677, filed Apr. 1, 2016, which claims priority from U.S. Provisional Application Ser. No. 62/142,313, filed on Apr. 2, 2015, the entire disclosure of which is incorporated herein by reference in its entirety.

TECHNICAL FIELD

The present disclosure relates to devices and method for perforating a subterranean formation.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent to the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

Conventionally, a perforating gun is assembled by affixing a detonating cord to one or more shaped charges disposed along a charge tube. In many cases, the detonating cord is wrapped external to the charge tube and fed through a hole in the charge tube opening. Aside being time consuming, conventional gun assembly methods sometimes damage the detonating cord.

Thus, there exists a need for devices that are less time consuming to assemble and less susceptible to damage. In other aspects, there exists a need for improved locking mechanisms and electrical grounding for such devices. The present disclosure addresses these and other needs of the prior art.

SUMMARY

In aspects, the present disclosure provides a perforating gun that includes a carrier tube and a charge tube assembly. The carrier tube includes a bore and at least one groove formed along an inner surface. The charge tube assembly is disposed in the bore of the carrier tube and includes a charge tube, an alignment end plate, an insertion end plate, a retention member, shaped charges, and a detonating cord. The charge tube has a plurality of shaped charge openings, a plurality of post openings, a first end, and a second end. The alignment end plate is connected to the first end of the charge tube. The insertion end plate is connected to the second end of the charge tube. The shaped charges are disposed in each of the shaped charge openings. Each shaped charge has a post projecting out of one post opening. The detonating cord is connected to each of the projecting posts.

In one embodiment, the retention member has at least one anchor segment connected to the alignment end plate and a radially outward segment that extends beyond an outer diameter of the alignment end plate in an extended position. The radially outward segment may be compressible smaller than an inner diameter of the carrier tube in a retracted position.

In another embodiment, the retention member may be a wire. The wire may have a hooked anchor segment fixed within the first opening on the end face, a coiled flexure segment at least partially fixed within the second opening on the end face, and a radially outward segment between the hooked anchor segment and the coiled flexure segment. The radially outward segment extends beyond an outer diameter of the alignment end plate in an extended position and is compressible to a second smaller diameter in a retracted position. The wire is configured to bias the radially outward segment against a surface defining the groove and form a metal-to-metal contact with the carrier and with the alignment end plate.

In another embodiment, the retention member is a fixed split retention member having a fixed end connected to the alignment end plate and a free end, the fixed split retention member being disposed in a first groove of the carrier tube. This embodiment also includes a free split retention member disposed in a second groove of the carrier tube.

It should be understood that examples of certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
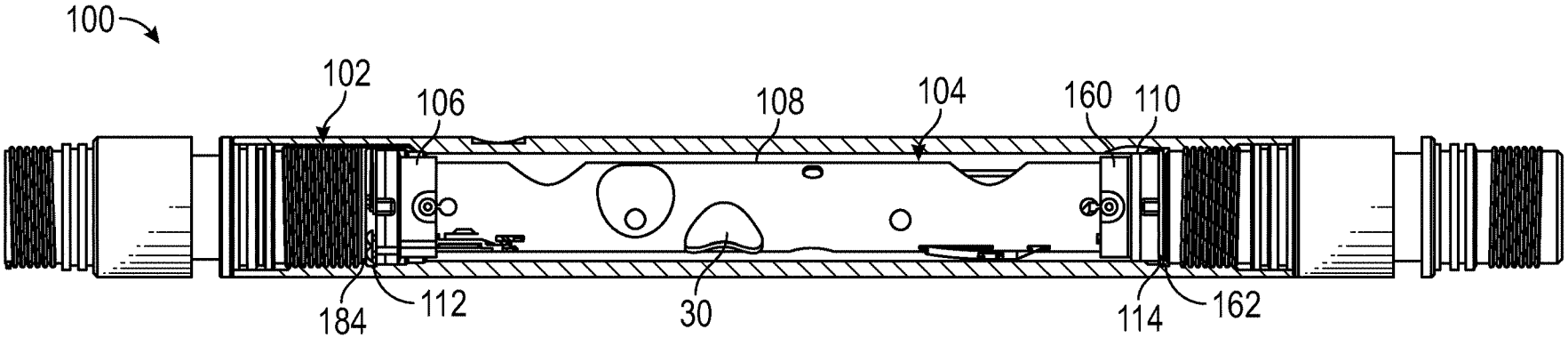
FIG. 1 schematically illustrates a side sectional view of a perforating gun according to one embodiment of the present disclosure.

The present disclosure relates to devices and methods for facilitating the assembly and enhancing the reliability of wellbore perforating tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is shown one embodiment of a perforating gun 100 in accordance with the present disclosure. For ease of discussion, devices such as shaped charges and detonating cords have been omitted. The perforating gun 100 may include a carrier 102 that is shaped to receive a charge tube assembly 104. In one arrangement, the charge tube assembly 104 includes an alignment end plate 106, a charge tube 108, an insertion end plate 110, and retention members 112, 114.

Figure 2A:
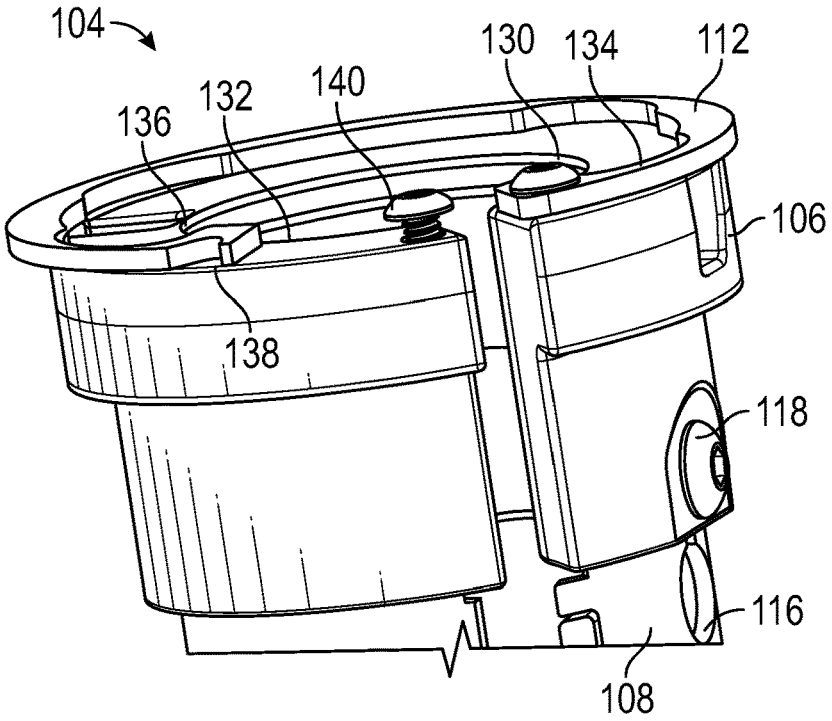
FIGS. 2A-2B schematically illustrate isometric end views of an alignment end plate for a perforating gun according to one embodiment of the present disclosure.
Figure 2B:
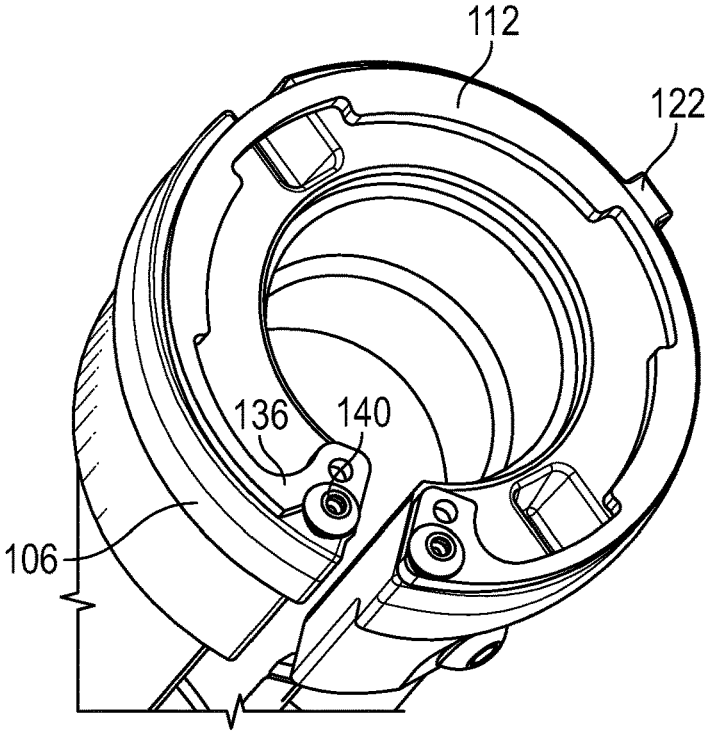

Referring now to FIG. 2A, there is shown a section of the charge tube assembly 104 that includes a fixed retention member 112 and the alignment end plate 106. The fixed retention member 112 provides selective biasing engagement between the alignment end plate 106 and the carrier 102 (FIG. 1). In one non-limiting arrangement, the fixed retention member 112 may be formed as an elastically deformable ring and may be compressed to a reduced diameter state. For example, the ring may be formed of a resilient material (e.g., spring steel) and may include a cut or split. The split allows the fixed retention member 112 to flex diametrically inward when compressed. The alignment end plate 106 may be a tubular member such as a collar that is fixed to a first end 116 of the charge tube 108 with a fastener 118. However, the alignment end plate 106 may also be formed integral with the charge tube 108. As shown in FIG. 2B, the alignment end plate 106 may include an alignment key 122 shaped and sized to mate with an alignment groove (not shown) of the carrier 102 (FIG. 1) during assembly.

Referring back to FIG. 2A, the fixed retention member 112 may be connected to the alignment end plate 106 using a connector 130. The connector 130 may be a screw, rivet, pin or other element that fixes the fixed retention member 112 to a face 132 of the alignment end plate 106. In one embodiment, the connector 130 prevents relative axial movement between the alignment end plate 106 and the fixed retention member 112, but allows some relative rotational movement. The connector 130 may be attached to a first end 134 of the fixed retention member 112. The fixed retention member 112 has a free end 136 that is not permanently fixed to the face 132 of the alignment end plate 106. Instead, the free end 136 may include a profile 138 that hooks into a post 140 formed on the face 132. As used herein a "profile" is a surface shaped in a desired manner. The post 140 may be any protrusion or feature that allows selective engagement with the free end 136. While the connector 130 and the post 140 are both shown as screws, it should be understood that these may be different structural elements.

FIG. 2A shows the fixed retention member 112 in a relaxed and diametrically expanded state. FIG. 2B shows that the fixed retention member 112 has been compressed to a diametrically contracted state. The fixed retention member 112 is held in this diametrically contracted state by the connection of the free end 136 and the post 140.

Figure 3:
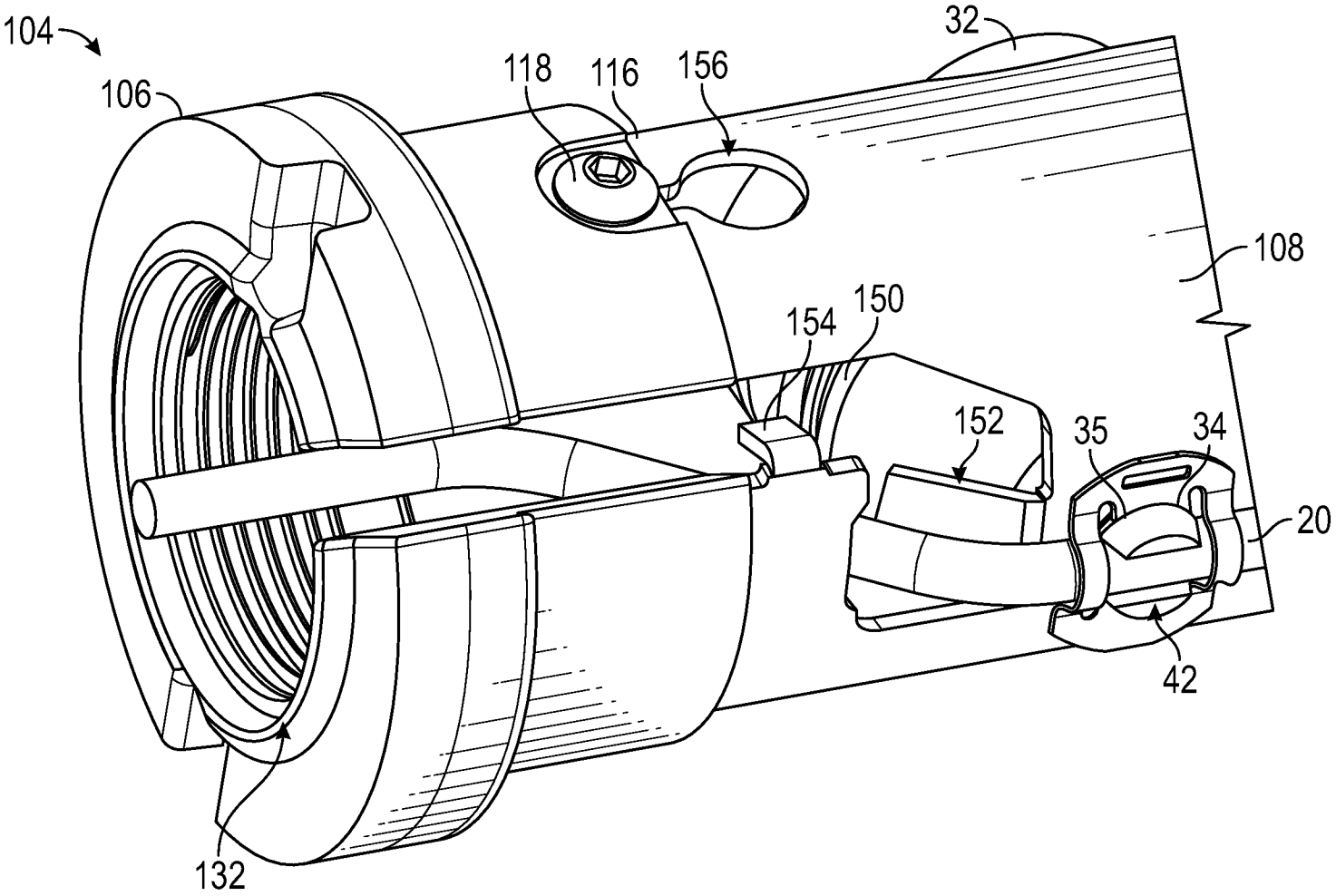
FIG. 3 schematically illustrates an isometric end view of an open slot for an alignment end plate for a perforating gun according to one embodiment of the present disclosure.

Referring now to FIG. 3, there is shown a section of the charge tube assembly 104 that includes the alignment end plate 106 and the charge tube 108. In one embodiment, the charge tube first end 116 and the alignment end plate 106 may include an open slot 150. As used herein, the term "open slot" refers to an opening that is, at least initially, not bound on all sides. That is, the open slot extends from a location axially inward of the first end 116 all the way to the face 132 of the alignment end plate 106. In some embodiments, tabs 152, 154 may be formed along the open slot 150. For instance, a tab 152 may be used to form a protective ramp that allows a detonating cord 20 to enter the charge tube 108 without encountering a sharp edge. The tab 154 may be formed as a bendable element that can be deformed to block a portion of the open slot 150 after the detonating cord 20 has been installed in the charge tube 108. Additionally, an opening 156 may be formed to allow wiring to run between the inside and the outside of the charge tube 108.

Figure 4:
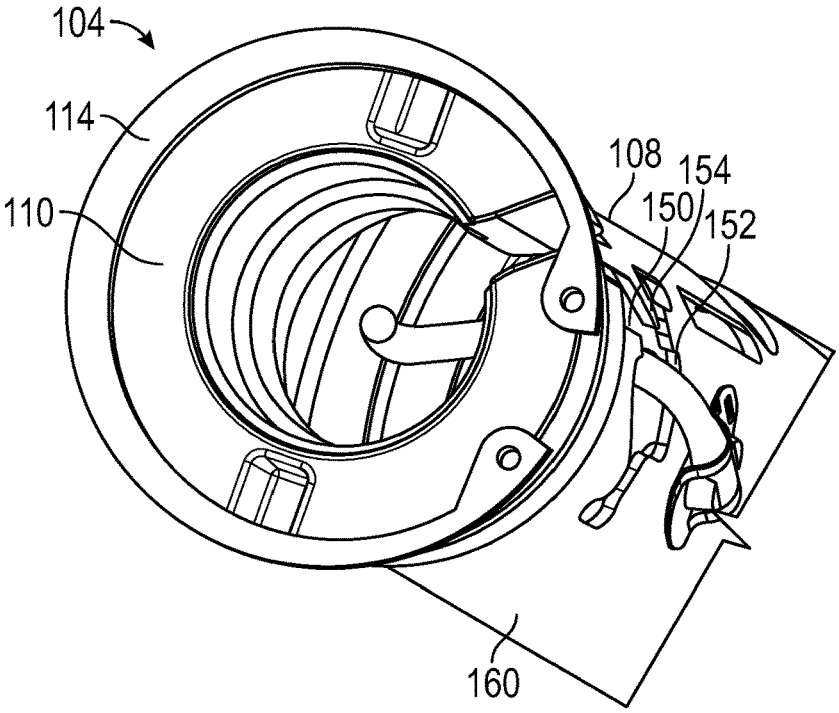
FIG. 4 schematically illustrates an isometric end view of an insertion end plate for a perforating gun according to one embodiment of the present disclosure.
Figure 5:
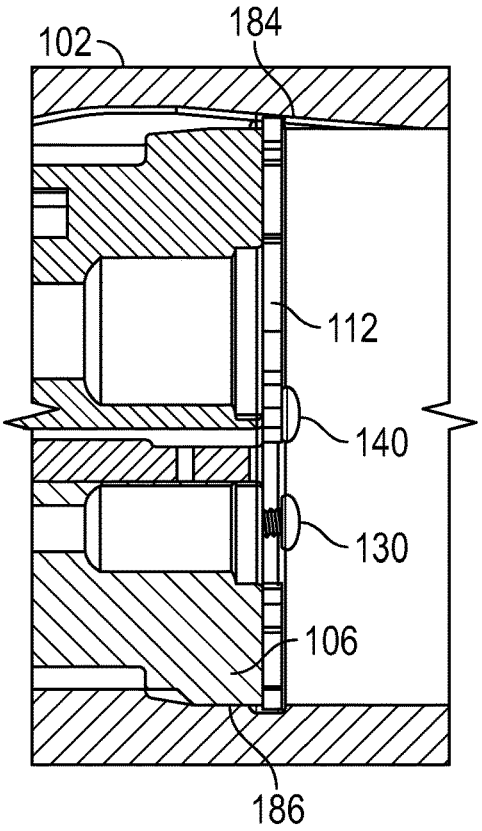
FIG. 5 schematically illustrates a fixed split retention member disposed in a carrier tube according to the present invention.

The arrangement of the insertion end plate 110 (FIG. 1) and the charge tube 108 is similar in many aspects to the FIG. 3 arrangement. Referring now to FIG. 4, there is shown a section of the charge tube assembly 104 that includes the insertion end plate 110 and the charge tube 108. In one embodiment, the charge tube second end 160 (FIG. 1) and the insertion end plate 110 may include an open slot 150. In some embodiments, tabs 152, 154 may be formed along the open slot 150. The slot 150 and tabs 152, 154 are similar in design to those discussed in connection with FIG. 3.

Referring now to FIGS. 2B and 4, in contrast to the alignment end plate 106, the insertion end plate 110 does not have an alignment key and is not fixed to the free retention member 114. Rather, the free retention member 114 effectively "floats" in an annular groove 162 (FIG. 1) or recess formed on an inner surface of the carrier 102. Like the fixed retention member 112, the free retention member 114 may be formed as a split annular ring. In one arrangement, the free retention member 114 may be formed of a resilient material (e.g., spring steel) that has a relaxed diametrically expanded size. The split allows the fixed retention member 112 to flex diametrically inward.

For a better understanding of the co-action among the several features described above, the assembly of the perforating gun 100 will be discussed.

As best shown in FIG. 1, the charge tube 108 may include a plurality of shaped charge openings 30 for receiving the shaped charges 32 that are shown in FIG. 3. The shaped charges 32 each have a post 34 that project through post openings 35 formed in the charge tube 108. The detonating cord 20 may be affixed to the shaped charges 32 by being seated firmly within a groove of the post 34. In one non-limiting embodiment, the post 34 may mate with an external clip 42. A non-limiting example of the external clip 42 is described in U.S. patent application Ser. No. 11/759,126, which is incorporated herein in its entirety.

Referring to FIG. 3, after the detonating cord 20 has been affixed within the groove of the shaped charge posts 34, the detonating cord 20 may be inserted into the bore of the charge tube 108 via the open slot 150 of the charge tube 108 and the alignment end plate 106. It should be noted that the open slot 150 allows a lateral insertion of the detonating cord 20 as opposed to an axial insertion. That is, an end of the detonating cord 20 does not have to be inserted into the charge tube 108. Rather, the detonating cord 20 may be slid laterally into the charge tube 108 while the portion of the detonating cord 20 entering the charge tube 108 is parallel with the long axis of the charge tube 108. Thus, the detonating cord 20 does not have to bend, which reduces the likelihood of kinking.

It should be appreciated that the first tab 152 provides a smooth surface on which the detonating cord 20 may lie. Further, the first tab 152 may form a physical barrier between the shaped charges 32 and the detonating cord 20. This physical barrier may act as a shield that prevents at least some of the energy associated with the detonating of the detonating cord 20 from impacting and damaging the shaped charge 32. The second tab 154 may be bent or otherwise deformed to obstruct at least a portion of the open slot 150.

Thus, the second tab 154 may act as a retaining element that keeps the detonating cord 20 from inadvertently falling out of the charge tube 108.

As noted previously, the charge tube assembly 104 may include other devices that have not been shown. For example, electrical wiring (not shown) may be installed in the bore of the charge tube 108. Wiring that may need to exit the charge tube 108, such as ground wire (not shown) may be fed through the opening 156. In the case of ground wires (not shown), these wires may be fed through the opening 156 and fixed to the fastener 118. The ground wire (not shown) may be used to provide an electrical connection with the electric detonator (not shown).

Referring to FIG. 1, the final assembly of the perforating gun 100 may include installing the retention members 112, 114. The free retention member 114 may be installed in the groove 162 of the carrier 102. Referring to FIGS. 2A,B, the fixed retention member 112 may be attached to the alignment end plate 106 by attaching the connector 130 to the first end 134 of the fixed retention member 112. To facilitate the installation, the free end 136 of the fixed retention member 112 is hooked to the post 140. Thus, the fixed retention member 112 is held in a reduced diametrical state.

Referring to FIGS. 1 and 2A,B, thereafter, the charge tube assembly 104 may be inserted into the carrier 102. The reduced diameter fixed retention member 112 is generally the same diameter as the alignment end plate 106 (e.g., +/−10% difference) to facilitate entry and assembly. The charge tube assembly 104 is inserted axially until the alignment key 122 is secured within the keyway of the carrier. The charge tube assembly 104 may be rotated as needed to align the alignment key 122 with the alignment groove (not shown) formed in the carrier 102. This alignment steps aligns the shaped charges 32 with scallops (not shown) formed along the carrier 102. Thereafter, the charge tube assembly 104 may be inserted until the second end 160 is next to the free retention member 114.

Referring to FIGS. 1, 2A, B and 5, to complete assembly, the free end 136 of the fixed retention member 112 is released from the post 140, which allows the fixed retention member 112 to revert to an expanded diametrical condition. The fixed retention member 112 expands into a locking relationship with a groove 184 formed on an inner surface of the carrier 102. The diameter of the groove 184 is sized such that the fixed retention member 112 remains partially compressed within the groove 184 and therefore applies a biasing spring force at the fastener 130. This force is transferred to the alignment plate 106, which is pushed into engaging contact with an inner surface 186 of the carrier 102.

It should be appreciated that the charge tube 104 nests between the two retention members 112, 114. Thus, the retention members 112, 114 cooperate to axially align the charge tube 104 relative to the carrier 102. It should be appreciated, however, that the retention members 112, 114 have different interaction with the charge tube 104. The retention member 112 is fixed to and moves with the charge tube 104. When seated in the groove, the retention member 112 can function as a seating surface for the charge tube 104 or act as a hanger from which the charge tube 104 can be suspended to some degree. The retention member 114 can function as only a seating surface because it is not connected to the charge tube 104. In certain embodiments, the retention member 112, 114 are axially spaced such that the retention member 112 never bears the full gravitational weight of the charge tube 104.

Referring to FIGS. 2A,B and 5, it should also be appreciated that the retention member 112 can help maintain continuous physical contact between the carrier 102 and the alignment end plate 106. As noted previously, a ground wire (not shown) may be attached to the alignment end ring 106 at the fastener 118 as part of an electrical circuit. The biasing force of the retention member enables positive contacting engagement between the fixed retention member 112 and the inner surface 186 of the carrier 102 and between the alignment end ring 106 and the inner surface 186 of the carrier 102. Thus, these contacting surfaces may be used to form an electrical circuit used to operate the perforating gun 100.

Figure 6A:
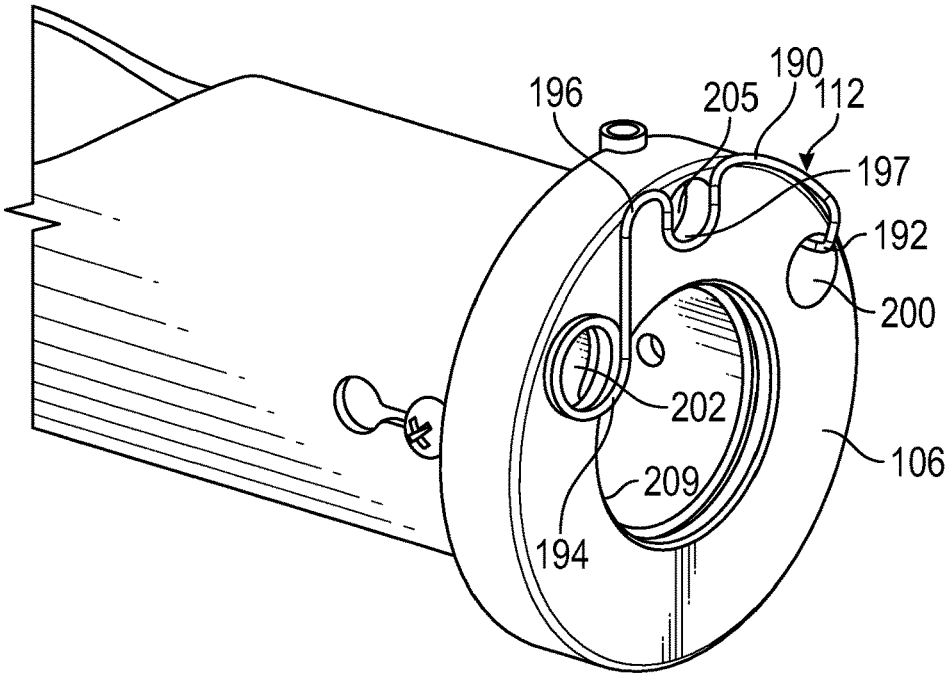
FIGS. 6A-B isometrically illustrates a elastically deformable retention member according to one embodiment of the present disclosure.
Figure 6B:
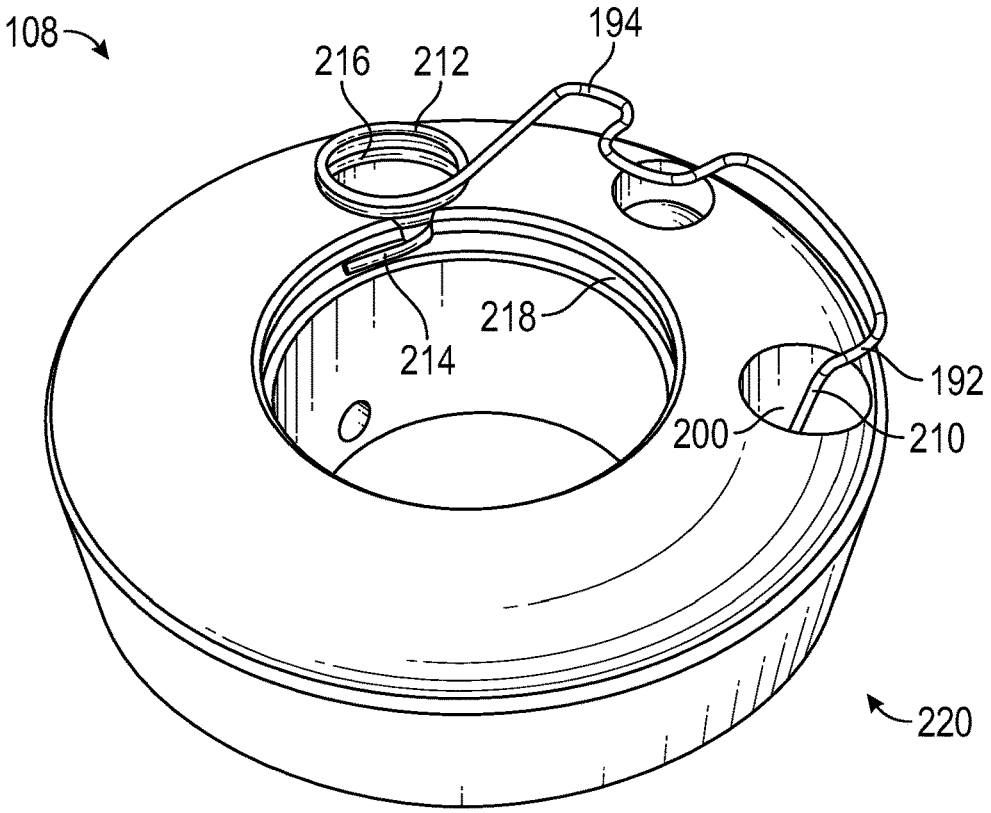

Referring now to FIGS. 6A-B, there is shown another embodiment of a retention member 112 in accordance with the present disclosure. In this embodiment, the alignment end plate 106 does not have an open slot. As before, the retention member 112 provides selective biasing engagement between the alignment end plate 106 and the carrier 102 (FIG. 1).

Referring to FIG. 6A, in one non-limiting arrangement, the retention member 112 may be formed as an elastically deformable clip, rod or coil. As shown, the retention member 112 is illustrated as a continuous length of wire having several shaped segments. For example, the retention member 112 may be formed of a resilient material (e.g., spring steel) and shaped to have a flexure segment 190, a first anchor segment 192, and a second anchor segment 194. The flexure segment 190 generate a biasing force that pushes one or more arcuate projecting segments 196 radially beyond the outer diameter of the end plate 106. By biasing, it is meant that the projecting segments 196 are biased in the radially outward direction, but can be compressed to a radially retracted state. The flexure segment 190 may have one or more arcuate cup segments 197 that are shaped to receive a jaw of pliers (not shown) during removal of the retention member 112. The first and second anchor segments 192, 194 are shaped to engage complementary openings 200, 202 formed in an end face of the end plate 106, respectively. As used herein, an end face means a surface that is transverse to a long axis of the charge tube. An end face can also be considered as a terminal surface of the end plate 106 that is perpendicular to an outer circumferential surface of the end plate 106. The endplate 106 also includes an opening 205 that is positioned adjacent to the cup segment 197. The openings 200, 202 may be through holes, blind holes, bores, grooves, cavities or any other features that can receive the anchor segments 192, 194.

Referring to FIG. 6B, in one non-limiting embodiment, the first anchor segment 192 may be formed as a hook 210 (e.g., a "J" shaped end). The opening 200 may be formed as a through hole in which the hook 210 latches. The second anchor segment 194 may be include a flexure segment 212 and a finger segment 214. The flexure segment 212 may be a segment that can adjust the spring force generated by the retention member 112. For instance, as shown, the retention member 112 is made of a continuous length of wire. Thus, the flexure segment 212 is a segment of coiled wire that allows more or less bending or deflection in the retention member 112. In other embodiments, the flexure segment may be a series of folds, twists, etc. The second opening 202 may include a cavity for 216 receiving the button shaped segment 212 and a groove 218 for receiving the finger segment 214.

It should be appreciated that the retention member 112 of FIGS. 6A and 6B may lock the charge tube assembly 108 into a suitable groove formed in the carrier 102 (FIG. 1), which eliminates the need for a separate snap ring. Such suitable grooves are shown in FIG. 1 as grooves 184 and 162. The retention member 112 may be attached prior to assembly. At this time the radially projecting segment 196 is biased to the extended position and has a extended radial length. When the charge tube assembly 104 is inserted into the carrier 102, the radially projection segment 196 is radially compressed smaller than an inner diameter of the carrier tube 102 in a retracted and slides along the inner surface of the carrier tube 102. Thus, during assembly, the resilient retention member 112 acts like a ratchet and the charge tube assembly 102 can be simply pushed into the carrier 102. When the retention member 112 snaps into and seats within the groove (e.g., groove 184 of FIG. 1), the retention member 112 provides a positive grounding mechanism for the electrical circuit used to fire the perforating gun. It should be noted that the retention member 112 is biased radially outward and pressed against a surface defining the groove 184 (FIG. 1). Because of the bias or spring force, a metal-to-metal contact is maintained between the carrier 102 and the retention member 112 and the retention member 112 and the alignment end plate 106. This is in contrast to a snap ring, which merely floats in a groove and does not maintain a positive grounding mechanism.

To remove the retention member 112 one jaw of the pliers (not shown) can be inserted into the opening 205 and the other jaw of the pliers (not shown) may wedge against an inner surface 209 of the end plate 106. Thus, when the pliers' jaws (not shown) are closed, the cup segment 197 is pulled radially inward, which allows the retention member 112 to be freed from the groove 220 of the carrier 102.

It should be noted that the teachings of the present disclosure are not limited to the specific perforating guns illustrated in the figures. For instance, the charge tube and detonator cord may be arranged using an internal and external weave, which would eliminate the need for clips. More generally, the present teachings may be applied to any perforating gun that uses a telescopically arranged carrier tube and charge tube.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

The invention claimed is:

1. A perforating gun, comprising:

a carrier tube including a bore and an inner surface, wherein the inner surface has on a first groove and a second groove formed therein; and a charge tube assembly disposed in the bore of the carrier tube, the charge tube assembly comprising:

a charge tube having a plurality of shaped charge openings, a plurality of post openings, a first end, and a second end;

an alignment end plate connected to the first end of the charge tube, the alignment end plate including a face and a protrusion formed on the face;

an insertion end plate connected to the second end of the charge tube;

a fixed split retention member having a fixed end connected to the alignment end plate and a free end, the fixed split retention member being disposed in the first groove of the carrier tube, wherein the free end of the fixed split retention member is configured to selectively engage the protrusion, wherein the fixed split retention member compressively engages the inner surface in which the first groove is formed, the fixed split retention member urging the alignment end plate into engagement with the inner surface of the carrier tube;

a free split retention member disposed in the second groove of the carrier tube;

a shaped charge disposed in each of the shaped charge openings, each shaped charge having a post projecting out of one post opening;

a detonating cord connected to each of the projecting posts; and a retaining element fixing the detonating cord to each of the projecting posts.

2. The perforating gun of claim 1, wherein a first open slot is formed extending from the face of the alignment end plate into the charge tube first end and a second open slot is formed extending from a face of the insertion end plate into the charge tube second end.

3. The perforating gun of claim 1, further comprising:

a fastener connecting the alignment end plate to the charge tube; and an electrical circuit formed by the fastener, a ground wire connected to the fastener, and an electric detonator connected to the ground wire.

4. A perforating gun, comprising:

a carrier tube including a bore and an inner surface, wherein the inner surface has a first groove and a second groove formed therein; and a charge tube assembly disposed in the bore of the carrier tube, the charge tube assembly comprising:

a charge tube having a plurality of shaped charge openings, a plurality of post openings, a first end, and a second end;

an alignment end plate connected to the first end of the charge tube, wherein a first open slot is formed extending from a face of the alignment end plate into the charge tube first end;

an insertion end plate connected to the second end of the charge tube, a second open slot is formed extending from a face of the insertion end plate into the charge tube second end;

a fixed split retention member having a fixed end connected to the alignment end plate and a free end, the fixed split retention member being disposed in the first groove of the carrier tube;

a free split retention member disposed in the second groove of the carrier tube;

a shaped charge disposed in each of the shaped charge openings, each shaped charge having a post projecting out of one post opening;

a detonating cord connected to each of the projecting posts;

a retaining element fixing the detonating cord to each of the projecting posts; and at least one tab associated with each of the first slot and the second slot.

5. The perforating gun of claim 4, wherein the at least one tab is configured to retain the detonating cord inside the charge tube.

6. The perforating gun of claim 4, wherein the at least one tab forms a physical barrier between the detonating cord and the at least one shaped charge within a bore of the charge tube.

7. A method of assembling a perforating gun, comprising:

(a) providing the perforating gun with:

a carrier tube including a bore and an inner surface, wherein the inner surface has a first groove and a second groove formed therein, and a charge tube assembly disposed in the bore of the carrier tube, the charge tube assembly comprising:

a charge tube having a plurality of shaped charge openings, a plurality of post openings, a first end, and a second end, an alignment end plate connected to the first end of the charge tube, the alignment end plate including a face and a protrusion formed on the face, an insertion end plate connected to the second end of the charge tube, a fixed split retention member having a fixed end connected to the alignment end plate and a free end, the fixed split retention member being disposed in the first groove of the carrier tube, wherein the free end of the fixed split retention member is configured to selectively engage the protrusion, a free split retention member disposed in the second groove of the carrier tube, wherein the fixed split retention member compressively engages the inner surface in which the first groove is formed, the fixed split retention member urging the alignment end plate into engagement with the inner surface of the carrier tube, a shaped charge disposed in each of the shaped charge openings, each shaped charge having a post projecting out of one post opening, a detonating cord connected to each of the projecting posts, and a retaining element fixing the detonating cord to each of the projecting posts;

(b) engaging the free end of the fixed split retention member with the protrusion before inserting the charge tube into the carrier tube; and (c) releasing the free end of the fixed split retention member from the protrusion after inserting the charge tube into the carrier tube.

* * * * *